US006700117B2

(12) United States Patent
Franzen

(10) Patent No.: US 6,700,117 B2
(45) Date of Patent: Mar. 2, 2004

(54) CONDITIONING OF AN ION BEAM FOR INJECTION INTO A TIME-OF-FLIGHT MASS SPECTROMETER

(75) Inventor: Jochen Franzen, Bremen (DE)

(73) Assignee: Bruker Daltonik GmbH, Bremen (DE)

( * ) Notice: Subject to any disclaimer, the term of this patent is extended or adjusted under 35 U.S.C. 154(b) by 456 days.

(21) Appl. No.: 09/798,250

(22) Filed: Mar. 2, 2001

(65) Prior Publication Data

US 2001/0054685 A1 Dec. 27, 2001

(30) Foreign Application Priority Data

Mar. 2, 2000 (DE) ..... 100 10 204

(51) Int. Cl.[7] ..... H01J 49/40; H01J 49/42

(52) U.S. Cl. ..... 250/287; 250/282; 250/281; 250/292

(58) Field of Search ..... 250/287, 282, 250/281, 292

(56) References Cited

U.S. PATENT DOCUMENTS

| | | | | |
|---|---|---|---|---|
| 5,373,156 A | | 12/1994 | Franzen | |
| 5,572,035 A | | 11/1996 | Franzen | |
| 5,689,111 A | | 11/1997 | Dresch et al. | |
| 5,708,268 A | * | 1/1998 | Franzen | 250/292 |
| 5,763,878 A | * | 6/1998 | Franzen | 250/292 |
| 5,869,829 A | | 2/1999 | Dresch | |
| 6,011,259 A | | 1/2000 | Whitehouse et al. | |
| 6,331,702 B1 | * | 12/2001 | Krutchinsky et al. | 250/281 |

FOREIGN PATENT DOCUMENTS

| | | |
|---|---|---|
| DE | 3856268 T2 | 7/1989 |
| WO | WO 99/38185 | 7/1999 |
| WO | WO/77823 A2 | 12/2000 |

OTHER PUBLICATIONS

Wiley, W.C. et al., "Time–of–Flight Mass Spectrometer with Improved Resolution", The Review of Scientific Instruments, 1955, vol. 26, No. 12, pp. 1150–1157.

Koslovsky, V. et al., "Cooling of Direct Current Beams of Low Mass Ions", International Journal of Mass Spectrometry, 1998, vol. 181, pp. 27–30.

* cited by examiner

*Primary Examiner*—Nikita Wells

(57) ABSTRACT

The invention relates to a method and a device which reduces the phase space volume of ions in an ion beam in such a way that their injection into a downstream time-of-flight mass spectrometer optimizes the performance of that spectrometer. The performance of the time-of-flight mass spectrometer, i.e. the sensitivity of the spectrometer, the temporal resolution for fast concentration changes of the examined substances, and particularly the mass resolving power, relates critically to the transmission of the ions.

The invention consists of completely decelerating the ions by means of collisions with a damping gas in an RF ion guide system, guiding them to the end of the ion guide system by active forward thrust, extracting them by a drawing lens system, and forming an ion beam with a low phase space volume. In particular, the ion guide system can take the form of a pair of wires coiled in a double helix and be surrounded by an envelope which is filled with the damping gas.

25 Claims, 1 Drawing Sheet

CONDITIONING OF AN ION BEAM FOR INJECTION INTO A TIME-OF-FLIGHT MASS SPECTROMETER

The invention relates to a method and a device which reduces the phase space volume of ions in an ion beam in such a way that their injection into a downstream time-of-flight mass spectrometer optimizes the performance of that spectrometer. The performance of the time-of-flight mass spectrometer, i.e. the sensitivity of the spectrometer, the temporal resolution for fast concentration changes of the examined substances, and particularly the mass resolving power, relates critically to the transmission of the ions.

The invention consists of completely decelerating the ions by means of collisions with a damping gas in an RF ion guide system, guiding them to the end of the ion guide system by active forward thrust, extracting them by a drawing lens system, and forming an ion beam with a low phase space volume. In particular, the ion guide system can take the form of a pair of wires coiled in a double helix and be surrounded by an envelope which is filled with the damping gas.

PRIOR ART

Time-of-flight mass spectrometers with orthogonal injection of a primary ion beam have a so-called pulser at the beginning of the flight path, which accelerates a section of the primary ion beam, i.e. a thread-like ion package, at right angles to the previous direction of the beam. A band-shaped secondary ion beam is created in which light-weight ions fly fast and heavier ions fly more slowly, and the flight direction of which is between the previous direction of the primary ion beam and the perpendicular direction of acceleration. Such a time-of-flight mass spectrometer is preferably operated in conjunction with a velocity-focusing reflector which reflects the band-shaped secondary ion beam over its entire breadth and deflects it to an also extended detector The mass resolution of such a time-of-flight mass spectrometer depends quite essentially on the spatial distribution and velocity distribution of the ions of the primary beam in the pulser.

If all the ions are flying exactly along an axis behind one another and if the ions do not have any velocity components at right angles to the primary ion beam, an infinitely high mass resolving power can, theoretically and very plausibly, be achieved because all the ions having the same mass are flying exactly in the same front and reach the detector at exactly the same time. If the primary ion beam has a finite cross section but none of the ions has a velocity component at right angles to beam direction, spatial focusing of the pulser can in turn theoretically bring about an infinitely high mass resolution (W. C Wiley and I. H. McLaren "Time-of-Flight Mass Spectrometer with Improved Resolution" Rev. Scient. Instr. 26, 1150, 1955). The high mass resolution can even be achieved if there is a strict correlation between the ion location (measured from the beam axis of the primary beam in the direction of acceleration) and the perpendicular ion velocity in the primary beam in the direction of acceleration. If, however, there is no such correlation, i.e. if the ion locations and perpendicular ion velocities are statistically distributed without any correlation between the two distributions, high mass resolution can no longer be achieved.

The primary ion beam has therefore to be conditioned relative to spatial and velocity distribution in order to achieve a high mass resolution in the time-of-flight mass spectrometer.

In the simplest case such a conditioning can be achieved with two coaxial apertured diaphragms with very small holes, which only admit beam ions which are flying along very parallel axes and axes which are close to one another. In this case the conditioning takes place at the expense of ion transmission, and therefore at the expense of the sensitivity of such a mass spectrometer. Generally speaking, such a solution with low sensitivity is undesirable.

The six-dimensional space of spatial and pulse coordinates is called the "phase space". In an ion beam the spatial and pulse coordinates of all the ions fill out a certain part of the phase space and that part is called the "phase space volume". Conditioning the primary beam therefore always means reducing phase space volume, at least in the coordinates at right angles to beam direction. A reduction in phase space volume cannot be achieved according to physical laws with ion-optical means but only by cooling the ion plasma of the ion beam, e.g. by cooling in a damping gas. Such cooling of the ions by a damping gas (at the expense of time) is known, for example, from high frequency quadrupole ion traps.

Time-of-flight mass spectrometers with orthogonal ion injection are preferably used for scanning high-resolution mass spectra with a fast spectrum sequence in order to be able to follow a separation of substances in fast methods of separation, capillary electrophoresis or microcolumn chromatography, for example, without any time smearing. Consequently, apart from high mass resolution, a high temporal resolution of subsequent substances is desirable. The cooling of the ions should therefore, if possible, take place by a continuous method which does not cause any mixing of earlier and later ions.

For time-of-flight mass spectrometers with preferably orthogonal injection an instrumental arrangement recently has became known from U.S. Pat. No. 6,011,259 (Whitehouse, Dresch and Andrien) in which multipole rod systems are used as ion guide systems ("multipole ion guides"), which guide ions from vacuum-external ion sources to the mass spectrometer and thus are also used for the selection of suitable parent ions and their fragmentation. The gas penetrating into the vacuum system together with the ions (usually nitrogen) is used as the collision gas for fragmentation, which also damps part of the motion of the ions but cannot be used systematically to reduce the phase space volume of the ions. Multipole rod systems used as ion guide systems do not have any active ion forward thrust; that is why in such systems the velocity must not be damped completely or else they can no longer pass through the ion guide system without mixing. On the other hand, they can be used as storage with requirement time-controlled outflow of the ions, but earlier and later ions mix and disturb the temporal resolution of fast chromatography and electrophoresis.

These multipole field ion guide systems consist of at least 2 pairs of straight pole rods which are evenly distributed over the surface of a cylinder and whose rods are alternately supplied with the two phases of an RF voltage. If there are two pairs of rods this is referred to as a quadrupole field, and if there are more than two pairs of rods they are referred to as hexapole, octopole, decapole, dodecapole fields etc. An ion-guiding dipole field with only one pair of rods cannot be generated. The fields are frequently termed 2-dimensional because in each cross section through the rod array the field distribution is the same. Consequently, field distribution only changes in two dimensions.

The RF multipole rod systems have become known as guide fields for ions between ion sources and ion consumers, particularly for feeding ions generated outside of the vacuum to RF or ICR ion traps inside vacuum systems.

The rod systems used for guiding ions are generally very slim in order to concentrate the ions in an area with a very small diameter. They can then advantageously be operated at low RF voltages and represent a good starting point for further ion-optical ion imaging. The clear cylindrical interior often only has a diameter of about 2 to 4 millimeters and the rods are less than 1 mm thick. The rods are usually fitted into grooves which are located inside of ceramic rings. The requirements for inside diameter uniformity, i.e. rod spacing, are relatively high. For this reason the system is not easy to make and it is also sensitive to vibrations and shock. The rod systems bend very easily and then they can no longer be adjusted.

On the other hand, U.S. Pat. No. 5,572,035 (Franzen) describes various ion guide systems which are completely different from the multipole rod systems described here. One of them consists of only 2 helically coiled conductors in the form of a double helix, which are operated by connecting up to the two phases of an RF voltage.

OBJECTIVE OF THE INVENTION

It is the aim of this invention to find methods and devices which condition the primary ion beam for time-of-flight mass spectrometers with orthogonal injection so that simultaneously a high sensitivity, high temporal resolution for changing ion compositions, and high mass resolution are achieved. For this the phase space volume in the primary ion beam must be reduced in particular.

SUMMARY OF THE INVENTION

The invention consists of using for the conditioning of the ions (a) an ion guide system of one of the known types, (b) completely damping the motion of the ions by filling gas so that they practically come to rest in the gas and gather along the axis of the ion guide system, (c) actively guiding the ions to the end of the ion guide system, (d) extracting them there through a drawing lens system, and (e) forming them into a conditioned beam of ions with a small phase space volume.

It is therefore particularly important to match the length of the ion guide system and the pressure of the damping gas to one another in such a way that the injected ions—apart from thermal diffusion motions—come to rest completely in the gas and collect along the axis of the ion guide system. Since the ions come to rest, it is necessary, by contrast with conventional use of such ion guide systems, to actively guide the ions to the end of the ion guide system.

The ion guide system can be a rod system supplied with RF voltages, whereby with four rods a quadrupole system can be built up, with six rods a hexapole system and with eight rods an octopole system. However, a simply constructed ion guide system in the form of a double helix, as described in U.S. Pat. No. 5,572,035 in detail, is particularly suitable for the present purpose.

Filling with gas can be achieved by operating the ion guide system in a vacuum chamber which is at a desired pressure of between 0.01 and 100 Pascal (preferably between 0.1 and 10 Pascal), or by at least partially enveloping the ion guide system so that only the envelope is filled with gas. The gas can then flow through the envelope and thus through the rod system or double helix.

The active forward thrust of the damped ions can take place in several ways: (1) the ions can most simply be driven by the introduced gas itself if the gas is fed in at the beginning of an envelope of the ion guide system and flows through the ion guide system to the end. (2) Due to a conical design of the ion guide system, a gentle forward thrust of the ions can be achieved. (3) The ion guide system can be provided with a weak axial DC field which guides the ions to the end of the ion guide system. For example, by supplying the pole rods or helical wires with a DC voltage, a voltage drop can be generated along the axis of the ion guide system. It is useful to make the pole rods or wires of the double helix from resistance wire. A very weak field of only approx. 0.01 to 1 volts per centimeter (preferably approx. 0.1 V/cm) is sufficient to provide the ions with forward thrust.

A drawing lens is an ion-optical lens which, at the same time as focusing (or defocusing), also imparts acceleration upon the ions. Both sides of the lens are therefore at different potentials. That is different from a so-called Einzel lens, which only has a focusing (or defocusing) effect but imparts no acceleration; the Einzel lens thus always has the same potential on both sides. Drawing lenses and Einzel lenses are generally made up of concentric apertured diaphragms at a fixed distance from one another. A drawing lens system is a system of ion-optical lenses in which at least one drawing lens is integrated; this means that a small-area location of origin of ions with uniform energy can be imaged at an even smaller-area image location (at the ion focus) with a narrow angle of focus or can also be transformed to a parallel beam with a narrow cross section.

A drawing lens can very efficiently withdraw the ions from the ion guide system if the potential of the second apertured diaphragm extends through the hole in the first apertured diaphragm into the ion guide system. The first apertured diaphragm is approximately at the axial potential of the ion guide. The hole in the second apertured diaphragm advantageously has a smaller diameter than that of the hole in the first apertured diaphragm. Also it is advantageous to design the three last diaphragms in the drawing lens system as an Einzel lens which handles the required focusing.

Since in the ion guide system a gas pressure prevails which is intentionally detrimental to ion motions but in a time-of-flight mass spectrometer a very good vacuum must prevail, these must be accommodated in separate vacuum chambers. Then it is advantageous to integrate the apertured diaphragm of the drawing lens system with the smallest hole into the wall between the vacuum chambers with a gastight seal. The diameter of the hole can be approx. 0.5 millimeters. To maintain a good pressure differential it is useful if the hole is made into a small duct. Two apertured diaphragms in the drawing lens system can also be used to generate a differential pump stage by pumping off between these two apertured diaphragms separately.

It is also helpful for maintaining a good pressure inside of the time-of-flight mass spectrometer if in the ion guide system the pressure of the damping gas decreases toward the end. This can be achieved if the gas is admitted at the beginning and if a pressure drop is created by openings in the envelope along the ion guide system.

The ion guide system can in particular also be used to fragment injected ions in order to scan their daughter ion spectra. The ions must then be injected with a kinetic energy which is sufficient for collisionally induced fragmentation. Here, for a good yield, but also for the downstream conditioning of the fragment ions, it is particularly important to decelerate the ions in the collision gas until they come to rest. The relatively slow guidance (in several milliseconds) of the ions, which are then practically at rest, toward the end of the ion guide system also helps to cool the daughter ions and cause short-living, highly excited daughter ions to decompose. As a result a daughter ion spectrum largely free of background noise is obtained in the time-of-flight spectrometer, which is not contaminated by scattered ions from ion decompositions during flight in the time-of-flight mass spectrometer.

To obtain clean daughter ion spectra without any extraneous companion ions it is useful to clean the wanted parent ions by removing all other companion ions. This is referred to as "ion selection". This normally takes place using an upstream mass spectrometer. Here any continuous filtering mass spectrometers can be used, for example magnetic sector field mass spectrometers. However, linear mass spectrometers such as quadrupole filters or Wien filters are particularly suitable. A Wien filter is a superimposition of a magnetic field and an electric field in such a way that the selected ions fly straight ahead so their magnetic deflection is just compensated by the electric deflection.—Use of a first mass spectrometer for ion selection, a collision cell for fragmentation and a second mass spectrometer for analysis of the daughter or fragment ions is referred to as "tandem mass spectrometry" or "MS/MS".

The parent ions can be selected in a variety of ways for generating daughter ions. All the isotope ions of a substance with the same charge can be selected, but also a single type of isotope ("monoisotopic" ions).

Figure 1:
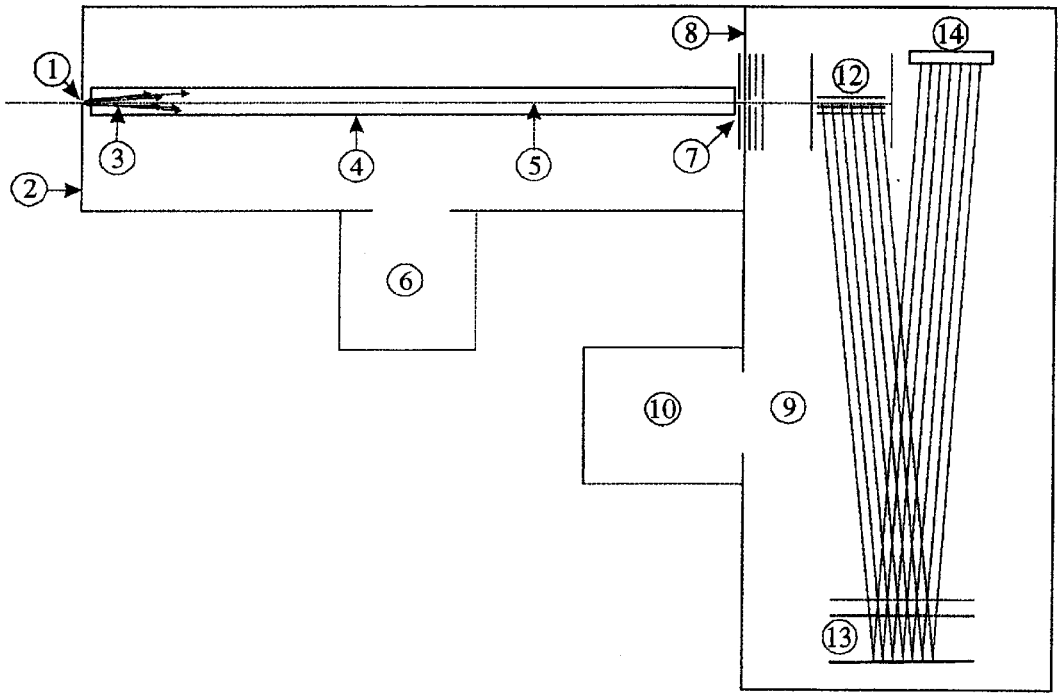
FIG. 1 shows a schematic diagram of the invention. A bundle of ions with various initial energies and initial directions pass through an aperture (1) in a vacuum chamber (2) into an ion guide system (4) which is located in a gastight envelope. Together with the ions, damping gas is also admitted to the ion guide system, which cannot escape because of the envelope and therefore has to flow to the end of the ion guide system. This ensures that sufficient gas is admitted so that the entering ions are completely decelerated by collisions and come to rest in the flowing gas of the ion guide system. Since in the ion guide system a pseudo potential prevails for the ions which is lowest along axis (5), the ions collect along axis (5). Due to gas friction, the flowing damping gas entrains the ions along axis (5) to the end of the ion guide system (4). Here a large part of the damping gas is emitted. It is pumped out by the vacuum pump (6) at vacuum chamber (2).

At the end of the ion guide system (4) is the drawing lens system (7), the second apertured diaphragm of which is integrated into the wall (8) between the vacuum chamber (2) for the ion guide system (4) and vacuum chamber (9) for the time-of-flight mass spectrometer. The drawing lens system (7) here is comprised of 5 apertured diaphragms; it extracts the ions from the ion guide system (4) and forms a fine ion beam with a low phase space volume which is focused on the pulser (12). When the pulser is just filled with flying ions, a short voltage pulse drives a wide package of ions out at right angles to the present direction of flight and forms a wide ion beam which is reflected in reflector (13) and is measured by an ion detector (14) with a high degree of temporal resolution.

Figure 2:
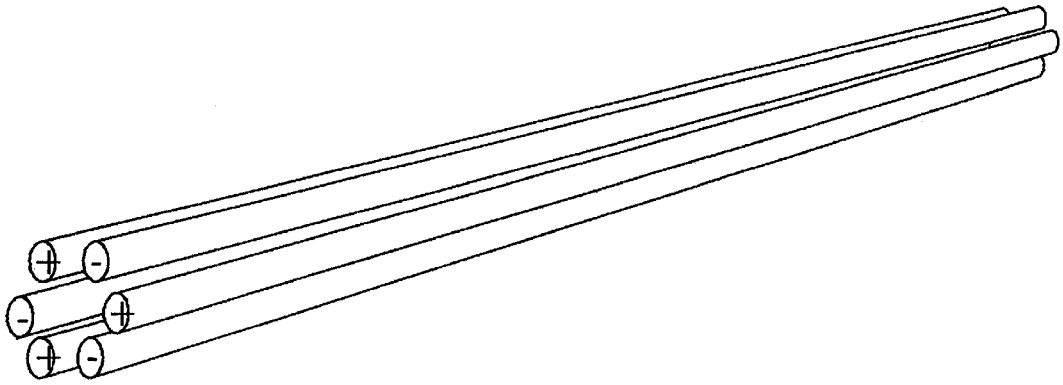

FIG. 2 shows a hexapole system which serves as an example of an ion guide system made from straight rods.

Figure 3:
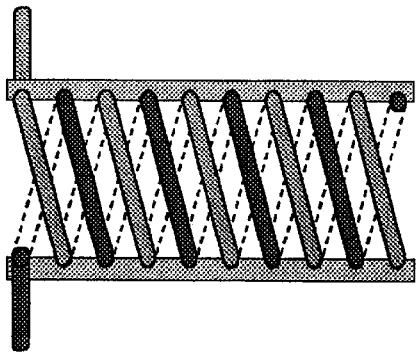

FIG. 3 shows a short section of an ion guide system which takes the form of a double helix.

PARTICULARLY FAVORABLE EMBODIMENTS

A time-of-flight mass spectrometer with orthogonal ion injection is chiefly operated with ion sources which generate large-molecule ions of substances which are of biochemical interest. Ionization takes place, for example, by matrix-assisted laser desorption of substances on sample supports in the vacuum (MALDI=matrix assisted laser desorption and ionization) or by electrospraying dissolved substances at atmospheric pressure outside of the vacuum system (ESI= electrospray ionization). In the latter case the ions are introduced to the vacuum through input apertures or input capillaries and the entrained ambient gas (usually nitrogen) is drawn off in several differential pumping stages. Refer, for example, to U.S. Pat. No. 6,011,259 (Whitehouse et al.).

The ions which have been generated by MALDI, ESI, or by another type of ionization are, according to a favorable embodiment, injected into an ion guide system somewhere on their journey to the time-of-flight mass spectrometer, as shown in principle in FIG. 1. That can already take place at an early stage in one of the differential pressure stages, whereby then the ion guide system can pass through the walls between differential pressure stages. However, this can also take place later in a separate vacuum chamber, as shown in FIG. 1. Upon injection the ions generally have a certain kinetic energy of several electron Volts which they have predominantly obtained due to an electric guidance field and which serves to transport them into the ion guide system. The energy must not be in excess of approx. 2 to 8 electron Volts if no fragmentation of the ions is to occur due to the subsequent collisions in the ion guide system.

An RF ion guide system has the property of keeping ions with moderate energy and not-too-small mass away from an imaginary cylindrical wall of the ion guide system (refer to U.S. Pat. No. 5,572,035). Consequently the ions are injected as if in a pipe. This is performed by a so-called pseudo potential field, a temporally averaged field of forces which acts on the ions (the pseudo potential is dependent on mass, although this is only of incidental interest here). The pseudo potential of all the ion guide systems which have become known so far has a trough in the axis of the ion guide system, it rises toward the imaginary cylindrical wall and reflects incident ions at the imaginary cylindrical wall.

The ion guide system can be a so-called multipole rod system supplied with RF voltages, whereby a quadrupole system can be constructed with four rods, a hexapole system with six rods (FIG. 2), and an octopole system with eight rods. For an ion guide system at least four rods are required—a dipole system comprised of only two rods cannot guide the ions. However, there is certainly a system comprised of only two poles which can guide the ions, although for this the poles do not have to be rods but spatially helically coiled wires (FIG. 3). For present purposes, such an ion guide system in the form of a double helix as in U.S. Pat. No. 5,572,035 is particularly suitable. Naturally one can also set up a coiled pole system made from four or more coils.

According to the invention the ion guide system is now so full of damping gas that the ions in the gas are completely decelerated. Depending on the length of the ion guide system a pressure of between 0.01 and 10 Pascal is required. The normally most favorable gas pressure is between 0.1 and 1 Pascal. The most favorable pressure is determined by experiment. The damping gas used can be helium but simply using the nitrogen from the ambient gas of the electrospray unit, which enters the vacuum system of the mass spectrometer together with the ions, has also proved successful. If the introduced ions are to be fragmented, heavier gases such as argon have also proved successful. The damping gas can be admitted to the vacuum chamber by a separate gas supply but it may also be admitted through an aperture from an upstream differential pumping chamber. It is favorable to surround the ion guide system with a narrow envelope which accommodates the damping gas; then it is not necessary to flood the entire vacuum chamber. If the ions are completely decelerated, they collect in the pseudo potential trough in the axis of the ion guide system. Due to their charge they repel each other and are thus distributed relatively uniformly.

According to the invention it is particularly favorable to use the gas also for transporting the entirely decelerated ions through the ion guide system: if the gas flows into the system close to the beginning of the envelope of the ion guide system, part of the gas flows to the end and can thus entrain the ions by viscous or molecular gas friction, that is, by large numbers of gentle collisions. In rod or double-helix shaped cylindrical ion guide systems without an axial DC field no axial forces act on the ions (except for a possible force due to the space charge of unequally distributed ions); entrainment by the gas therefore takes place without any resistance. The gas is then automatically filled into the envelope of the ion guide system at the beginning when it flows through an aperture from an upstream differential pump chamber. The time to reach the end of the ion guide system is a few milliseconds. Apart from a very weak mixing by diffusion, no mixing of ions injected earlier and later occurs. At the end the ions are removed in practically the same sequence in which they were injected: temporal resolution of the ion composition remains intact if removal of the ions takes place continuously at the end and is not stopped occasionally or periodically.

Transportation of the ions to the end of the ion guide system can, however, also be achieved solely or additionally by other means of forward thrust. The ion guide system can take the form of a cone (instead of a cylinder), in which case a pseudo potential field component is then created in an axial direction, which can be exploited for transportation.

Generation of a real electric DC field along the axis of the ion guide system is even more favorable. This can be achieved by applying equal DC voltages to both ends of all the pole rods or to the ends of the two helical wires. This is where one can see especially how favorable the double helix is because only two equal DC voltages have to be applied. The voltage supplies then have to be superimposed with the RF voltage. It is expedient to use resistance wires for the double helix and send only a very small direct current through each of the two wires. Here too the double helix is particularly favorable because the wires are very long on account of the coiling and can also be kept very thin, which has a favorable effect for a high resistance. Discharge of RF into the DC supply can be prevented very efficiently with RF chokes. The axial DC field only needs to be very weak: 0.01 to a maximum of 1 volt per centimeter is sufficient for forward thrust. Preferably approx. 0.1 volt per centimeter is applied.

Naturally several forward thrust mechanisms can also be coupled together. It is also possible to run the forward thrust mechanisms counter to one another as long as only one component remains which guides the ions to the end of the ion guide system. As a result it is possible to use a conical or trumpet-shaped ion guide system which is open wide at the injection end in order to be able to also collect all the ions at larger angles, while at the output end it should be very narrow in order to create a fine thread of ions along the axis. This system creates a pseudo force which drives back the ions to the injection end but this weak pseudo force can easily be overcome by a stronger flow of gas or a DC field.

Any ion guide system has the property of collecting and guiding only ions above a set mass-to-charge ratio. Lighter ions escape from the system. In this context, one refers to a lower mass limit of the ion guide system; this depends on the geometry of the ion guide system, the frequency and the amplitude of the RF voltage. For the analysis of large ions from substances of biochemical interest this limit is generally irrelevant.

At a frequency of approx. 6 megahertz and a voltage of approx. 250 V all the singly charged ions with masses above 50 atomic mass units are focused in a double helix. Lighter ions, for example air ions $N_2^+$ and $O_2^+$, leave the ion guide. Due to higher voltages or lower frequencies the cutoff limit for the ion masses can be increased to arbitrary values up to approx. 1,000 atomic mass units. The exact function of the lower mass cutoff limit in relation to voltage and frequency is determined experimentally by a calibration process.

No upper mass limit exists for such a system if the RF voltage is not superimposed by a DC voltage. If an upper mass limit is required, it can be generated: for this the two phases of the RF voltage can each be superimposed with a different DC voltage potential. An upper mass limit is favorable for a time-of-flight spectrometer if a very high scanning rate is to be maintained. Then no ghost peaks occur in the next spectrum which emanate from very heavy and therefore very slow ions from the previous cycle of scanning. However, an upper mass limit always increases the lower mass limit. The mass range can even therefore be restricted to a single mass. With such a device it is thus already possible to preselect ions. Here too the mass range can be determined by a calibration process and made adjustable, reproducible for use.

If the ions are fed to the end of the ion guide system, they are extracted by a drawing lens system. A drawing lens system is an ion-optical means by which ions of an originating location covering an area can be imaged at an image location which also covers an area, whereby the ions are simultaneously subjected to acceleration. If the ions of the originating location have energy which is very uniform, an image location can be generated which is smaller than the originating location.

The ions strung along the axis of the ion guide system in a thread and now only having thermal energies can thus be excellently formed with a drawing lens system into an extremely fine primary ion beam which is directed into the pulser of the time-of-flight spectrometer. The end surface of the ion thread in the ion guide system forms the originating location for the drawing lens. The ions in the fine primary ion beam, which is formed by the drawing lens system, are accelerated by an adjustable voltage to a level of energy which is favorable for the pulser. Depending on the length of the pulser and scanning cycle time the levels of energy are between approx. 5 and 50 electron Volts. In the pulser a narrow focal point (as the image location of the end surface of the ion thread in the ion guide system) can be generated; however, generation of a fine parallel beam may also be preferred. The most favorable setting for the generated ion beam depends on the properties of the time-of-flight mass spectrometer; it can easily be determined by experiment.

It is expedient for the drawing lens system to be comprised of a drawing lens which removes the ions from the ion guide system and normally generates an intermediate focus, and a downstream Einzel lens which images the intermediate focus into the pulser. The system comprised of the drawing lens and the Einzel lens can, in an extreme case, be reduced to only four apertured diaphragms, of which the last three form the Einzel lens. However, it is favorable to use a system made up of five apertured diaphragms, whereby the first three apertured diaphragms form the drawing lens and the last three apertured diaphragms form the Einzel lens. The center apertured diaphragm belongs to both lenses jointly. The first apertured diaphragm is practically at the axial potential of the ion guide system, and the third and fifth at the acceleration potential for the ions in the primary beam. The potential of the second diaphragm controls the ion extraction of the drawing lens and the potential of the fourth diaphragm controls the focal length of the Einzel lens.

If the pulser is filled with ions of the primary beam, in the ion-filled pulser a high acceleration field is switched on very quickly (in a few nanoseconds) and the field accelerates the ions at right angles to their previous direction out of the pulser in the form of a wide ion package. The acceleration field can be generated by switching on a voltage across one of the two diaphragms (or across both of them simultaneously), through which the primary beam flies. When the ions have left, the voltage must be switched off again so that the pulser can fill up with (flying) ions again from the continuously activated primary ion beam. Consequently a voltage pulse with a relatively short length is applied and that is why it is referred to as a "pulser". As indicated in FIG. 1, the pulser can have two acceleration sections, whereby the acceleration field always remains switched on in the second section; then the pulsed voltage does not need to be so high for the first acceleration section.

The outpulsed wide ion package now flies at an angle, which is between the direction of the primary ion beam and the acceleration direction, toward the reflector, is reflected there as a broad band, and then flies to the ion detector where the temporally variable ion flow indicates the times of flight of the ions which have different mass-to-charge ratios. A package of ions with the same mass-to-charge ratio therefore forms a thread which remains parallel to the primary beam during flight; all the ions with the same m/e of the package enter and reemerge from the likewise parallel reflector simultaneously and are also detected simultaneously in the likewise parallel detector. Then the flight times, and after that the mass-to-charge ratios, are calculated from the ion beam signal.

Naturally there must be a good vacuum prevailing in the time-of-flight mass spectrometer in order not to generate scattered ions due to collisions between ions and residual gas, which results in background noise in the spectrum. In the ion guide system, on the other hand, a gas pressure intentionally prevails which generates a large number of collisions with the ions. The spectrometer and the ion guide system must therefore be accommodated in different vacuum chambers which contain vacuums of various integrity. The ion passage between the two chambers must therefore not have a good conductivity for the passage of gases. It is therefore expedient to make the drawing lens diaphragm with the smallest hole the only connection between the chambers, i.e. to integrate the diaphragm into the wall between the two chambers with a gastight seal. This diaphragm can also take the form a small channel which reduces the conductivity again. For a vacuum pump with a large suction capacity connected to the spectrometer chamber this arrangement is sufficient. If for economic reasons a smaller pump is to be used, it is favorable to connect the pump to the drawing lens system specially between two suitable diaphragms, i.e. to select a differential pump arrangement.

Furthermore, for maintaining good pressure in the time-of-flight mass spectrometer it is helpful if in the ion guide system the pressure of the damping gas decreases toward the end. This can be achieved if the gas initially flows into the enveloped ion guide system and if through apertures in the envelope along the ion guide system a continuous or discontinuous pressure drop is created so that at the apertured diaphragm for the spectrometer chamber the gas density is no longer extremely high.

In particular the ion guide system can also be used to fragment injected ions in order to scan a daughter ion spectrum of the parent ions injected into the ion guide system. For this the parent ions must be injected with a kinetic energy which is sufficient for their intrinsic collisionally induced fragmentation. One must bear in mind that in the ion guide system there are not only hard collisions which lead to energy absorption in the ion and ultimately to fragmentation but there are also constantly cooling collisions which can dissipate energy from the molecular system of the ion again. For this reason accelerations to approx. 20 to 30 electron Volts per ion charge are necessary although the chemical bonding energies in the molecule are only about five electron Volts. Here it is advantageous to supply a collision gas with a mass which is not too small because this makes the collisions harder. While the damping gas used is often helium or, if, it is present anyway, nitrogen, for collisionally induced fragmentation at least nitrogen should be preferred, but argon would be even better. Even heavier gases can also be used.

For a good yield, but also for the downstream conditioning of the fragment ions it is particularly important here to decelerate the ions in the collision gas until they come to rest, also in this case of fragmentation. The relatively slow guidance (in several milliseconds) of the ions, then practically at rest, to the end of the ion guide system is also helpful in cooling the daughter ions and causing short-living, highly excited daughter ions to decompose. As a result a largely background noise-free daughter ion spectrum is obtained in the time-of-flight spectrometer which is not contaminated by scattered ions from ion decompositions during flight in the time-of-flight mass spectrometer.

To obtain clean daughter ion spectra without extraneous companion ions it is useful, with a supply of ions from an ion source, to install an upstream mass spectrometer, to select only the required parent ion type, and then to feed them to the ion guide system for fragmentation. This is referred to as "ion selection". Here arbitrary, continuously filtering mass spectrometers can be used, for example, magnetic sector field mass spectrometers. However, linear mass spectrometers such as quadrupole filters or Wien filters are particularly suitable. A Wien filter is a superimposition of a magnetic field and an electric field so that the selected ions just fly out, that is, their magnetic deflection is just compensated by the electric deflection. If the ions do not emerge from the first mass spectrometer with the kinetic energy required for fragmentation, the ions must subsequently be either accelerated or decelerated. From a quadrupole mass filter they usually have to be post-accelerated while from a Wien filter, on the other hand, they have to be decelerated.

Use of a first mass spectrometer for ion selection, a collision cell for fragmentation, and a second mass spectrometer for analysis of the daughter or fragment ions is referred to as "tandem mass spectrometry" or "MS/MS". The parent ions can be selected for the generation of daughter ions in a variety of ways. One can select all the isotope ions of a substance with the same charge but also only a single isotopic type ("monoisotopic" ions).

An ion guide in the form of a double helix can be made very easily and it then constitutes a robust setup which is highly resistant to mechanical damage and vibration. Using a two-turn screw core, which can be very easily made on a lathe for this purpose, the two wires of the double helix can very easily be wound, whereby the wires are inserted in the two thread turns of the two-turn screw core. It is advantageous if the thread turns are less than half as deep as the diameter of the wire. Sprung hard wire can be precoiled by winding onto a thin core beforehand and then stretching it so that there is practically no further wrap tension. Then insulating retaining strips or—as envelopes—insulating half-shells are stuck onto the windings while the windings are still on the screw core. The half-shells can have holes in order to generate the pressure drop toward the end. Retaining strips or half-shells can be made from glass, ceramics, or even from plastics. Retaining strips or half-shells can have obliquely milled round grooves which correspond to the diameter, spacing, and pitch of the wires. The sticking creates a very firm structure because the wires, which are actually already hard, are each attached at short spaces of up to one half a turn. After the adhesive has hardened, the screw core, which has been lightly greased beforehand, can be unscrewed from the structure.

The time-of-flight mass spectrometer can be operated at a very high clock rate, for example at 20,000 spectra per second, of which larger numbers of individual spectra are normally very quickly added to sum spectra after digitization. The time-of-flight mass spectrometer can advantageously supply a very high mass precision. However, on the other hand, with 10 to 20 (or even more) sum spectra per second it can also provide a high substance resolution if the mass spectrometer is preceded by a fast separating system. The ion source for this mass spectrometer can thus be coupled to very fast separating systems for sample separation, for example with capillary electrophoresis or micro-column liquid chromatography. These sample separators then supply temporally separated batches of substance of a very short duration at a high level of concentration, which are temporally well resolved by conditioning the primary beam for the time-of-flight mass spectrometer in accordance with the invention.

With the basic principles of the invention described here any specialist in developing mass spectrometers can very easily develop a time-of-flight mass spectrometer which is ideally adapted to certain analytical tasks of the spectrometer.

What is claimed is:

1. Method for generating a conditioned primary ion beam for a time-of-flight mass spectrometer, comprising the following steps:

a) injection of the ions into a rod-shaped or double-helix-shaped RF ion guide system, b) damping the ion motions in the ion guide system by means of collisions with a damping gas of sufficiently high pressure until the ions come to rest in the gas, whereby the ions collect along the axis of the ion guide system, c) guidance of the ions by active forward thrust to the end of the ion guide system, d) extraction of the ions through a drawing lens system at the end of the ion guide system, and e) forming a fine primary ion beam by the drawing lens system.

2. Method according to claim 1, wherein the damping gas has a pressure of between 0.01 and 100 Pascal.

3. Method according to claim 1, wherein the damping gas is introduced to an envelope which encloses the ion guide system.

4. Method according to claim 1, wherein at least part of the active forward thrust of the ions is generated by a current of the damping gas to the end of the ion guide system.

5. Method according to claim 1, wherein at least part of the active forward thrust is generated by an axial component of the pseudo potential which occurs due to a slightly conical ion guide system.

6. Method according to claim 1, wherein at least part of the active forward thrust is generated by an axial electric DC field in the ion guide system.

7. Method according to claim 6, wherein the axial electric DC field is generated by DC voltages which are maintained along the rods or helical wires of the ion guide.

8. Method according to claim 1, wherein the two phases of the RF voltage of the ion guide system are each superimposed with a DC voltage potential, whereby the ion guide system acts as a filter for ions with a selectable range of mass-to-charge ratios.

9. Method according to claim 1, wherein the ions injected into the ion guide system have a kinetic energy sufficient for their collisionally induced fragmentation in the damping gas.

10. Method according to claim 9, wherein the injected ions pass through an upstream mass spectrometer so that ions of a desired range of mass-to-charge ratios are selected.

11. Method according to claim 10, wherein the ions are selected by an upstream quadrupole filter mass spectrometer.

12. Method according to claim 10, wherein the ions are selected by an upstream Wien filter.

13. Device for implementing the method as described in claim 1, comprising an RF ion guide system, a gas supply for damping gas to the ion guide system, an active forward thrust system for the ions in the ion guide system, and a drawing lens system at the end of the ion guide system which can extract the ions from the ion guide system and form them into a fine primary ion beam.

14. Device according to claim 13, wherein the ion guide system has the shape of a double helix.

15. Device according to claim 13, wherein the ion guide system is largely enclosed by an envelope and the damping gas enters the envelope close to the beginning of the ion guide system, as a result of which the gas flow in the ion guide system forms a forward thrust system for the ions.

16. Device according to claim 13, wherein the damping gas enters the vacuum system of the ion guide system together with ions generated outside of the vacuum, through entrance capillaries and/or entrance apertures.

17. Device according to claim 13, wherein the ion guide system opens conically toward the end, as a result of which a forward thrust system is formed for the ions by an axial component of the pseudo potential.

18. Device according to claim 13, wherein a DC voltage is applied to both ends of all the pole rods or helical wires of the ion guide system in such a way that an axial DC field is created in the ion guide system which forms a forward thrust system for the ions.

19. Device according to claim 18, wherein the pole rods or wires of the double helix are made from resistance wire.

20. Device according to claim 13, wherein the drawing lens system is comprised of at least three apertured diaphragms at three different potentials.

21. Device according to claim 13, wherein the drawing lens system is comprised of at least four apertured diaphragms, of which the last three form an Einzel lens.

22. Device according to claim 20, wherein the apertured diaphragm with the smallest hole is integrated with a gastight seal into the vacuum partition between the vacuum chamber for the ion guide system and the vacuum chamber for the time-of-flight mass spectrometer.

23. Device according to claim 13, wherein the ion guide system is preceded by a mass spectrometer which can select ions of a mass-to-charge range, and wherein a voltage supply between the output of the mass spectrometer and the input of the ion guide system generates a voltage in such a way that the kinetic energy of the ions upon entry to the ion guide system is sufficient to fragment the ions by collisionally induced processes with the damping gas.

24. Device according to claim 23, wherein the upstream mass spectrometer is a quadrupole mass filter.

25. Method for generating a conditioned primary ion beam for a time-of-flight mass spectrometer using a rod-shaped or double-helix shaped RF ion guide system, wherein the ions injected into the ion guide system are completely damped in their motion due to collisions with a damping gas at sufficiently high pressure, the ions damped in their motion are guided by an active forward thrust to the end of the ion guide system, and a drawing lens system at the end of the ion guide system extracts the ions from the ion guide system and forms them into a fine primary ion beam.

* * * * *